US010823502B2

(12) United States Patent
Herman et al.

(10) Patent No.: US 10,823,502 B2
(45) **Date of Patent: *Nov. 3, 2020**

(54) APPLIANCE FOR DRYING ARTICLES

(71) Applicant: WHIRLPOOL CORPORATION, Benton Harbor, MI (US)

(72) Inventors: Mark L. Herman, Saint Joseph, MI (US); Garry L. Peterman, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/709,977

(22) Filed: Dec. 11, 2019

(65) Prior Publication Data

US 2020/0149812 A1 May 14, 2020

Related U.S. Application Data

(63) Continuation of application No. 15/782,426, filed on Oct. 12, 2017, now Pat. No. 10,533,798, which is a (Continued)

(51) Int. Cl.
*F26B 3/34* (2006.01)
*H05B 6/54* (2006.01)
(Continued)

(52) U.S. Cl.
CPC ..... *F26B 3/343* (2013.01); *D06F 58/20* (2013.01); *D06F 58/266* (2013.01); *H05B 6/54* (2013.01); *H05B 6/62* (2013.01)

(58) Field of Classification Search
CPC . F26B 3/343; F26B 7/002; F26B 3/34; H05B 6/54; H05B 6/62; D06F 58/266; D06F 58/20; D06F 58/10
(Continued)

(56) References Cited

U.S. PATENT DOCUMENTS 1,503,224 A * 7/1924 Blaine ..... B41F 23/0486 34/255
1,871,269 A * 8/1932 Hobrock ..... H01G 13/04 204/551
(Continued)

FOREIGN PATENT DOCUMENTS

EP 0269358 A2 6/1988
EP 0269358 A3 8/1989
(Continued)

OTHER PUBLICATIONS

European Search Report for Corresponding EP14178568.3, dated Feb. 16, 2015.
(Continued)

*Primary Examiner* — Edelmira Bosques
*Assistant Examiner* — Bao D Nguyen
(74) *Attorney, Agent, or Firm* — McGarry Bair PC

(57) ABSTRACT

An RF laundry dryer includes, amongst other things, an RF generator, an RF applicator having a perforated body and anode and cathode elements, a fan arranged relative to the perforated body to flow or draw air through the perforated body and an electromagnetic shield protecting the fan from the e-field. Both anode and cathode elements are operably coupled to the RF generator to generate an e-field between the anode and cathode upon the energizing of the RF generator.

20 Claims, 5 Drawing Sheets

Related U.S. Application Data continuation of application No. 13/966,577, filed on Aug. 14, 2013, now abandoned.

(51) Int. Cl.
*H05B 6/62* (2006.01)
*D06F 58/20* (2006.01)
*D06F 58/26* (2006.01)

(58) Field of Classification Search
USPC ..... 34/255, 250; 219/773, 780
See application file for complete search history.

(56) References Cited

U.S. PATENT DOCUMENTS 2,112,418 A * 3/1938 Hart, Jr. ..... F26B 3/34 34/255
2,212,522 A * 8/1940 Hart, Jr. ..... F26B 3/34 219/766
2,226,871 A * 12/1940 Nicholas ..... D21F 5/165 219/773
2,228,136 A * 1/1941 Hart, Jr. ..... A43D 25/20 12/33.2
2,231,457 A * 2/1941 Stephen ..... H05B 6/50 34/254
2,276,996 A * 3/1942 Milinowski ..... 607/101
2,373,374 A * 4/1945 Bierwirth ..... 536/56
2,449,317 A * 9/1948 Pitman ..... 219/777
2,473,251 A * 6/1949 Hsu ..... H05B 6/788 219/773
2,492,187 A * 12/1949 Rusca ..... H05B 6/54 219/773
2,511,839 A * 6/1950 Frye ..... F26B 11/0495 34/255
2,512,311 A * 6/1950 Davis ..... H05B 6/788 219/775
2,542,589 A * 2/1951 Stanton ..... H05B 6/54 219/780
2,582,806 A * 1/1952 Nes ..... D01D 10/0409 34/255
2,642,000 A * 6/1953 Wieking ..... F26B 3/347 101/416.1
2,656,839 A * 10/1953 Howard ..... A61N 1/40 331/60
2,740,756 A * 4/1956 Thomas ..... F26B 3/347 204/551
2,773,162 A * 12/1956 Christensen ..... B64D 15/12 219/770
3,089,327 A * 5/1963 Stilwell, Jr. ..... D06F 37/268 68/139
3,161,480 A * 12/1964 Ake Birch-Iensen ... H05B 6/46 34/255
3,184,637 A * 5/1965 Skinner ..... H01L 29/00 315/129
3,316,380 A * 4/1967 Pansing ..... G01R 29/0878 219/763
3,355,812 A * 12/1967 Bennett ..... F26B 3/34 34/250
3,364,294 A * 1/1968 Garibian ..... D02J 1/224 264/479
3,426,439 A * 2/1969 Rymanan ..... H05B 6/788 34/259
3,439,431 A * 4/1969 Heidtmann ..... D06F 58/30 34/261
3,537,185 A * 11/1970 Ingram ..... H05B 6/60 34/255
3,543,408 A * 12/1970 Candor ..... D21F 5/00 34/250
3,601,571 A * 8/1971 Curcio ..... H05B 6/04 219/650
3,652,816 A * 3/1972 Preston ..... F26B 3/34 219/773
3,701,875 A * 10/1972 Witsey ..... H05B 6/54 219/778
3,754,336 A * 8/1973 Feild ..... B60S 3/002 34/230
3,878,619 A * 4/1975 Hodgett ..... D06C 7/00 34/247
3,953,701 A * 4/1976 Manwaring ..... H05B 6/54 219/780
3,969,225 A * 7/1976 Horowitz ..... B03C 7/00 209/127.2
4,014,732 A * 3/1977 Beckert ..... B42C 13/006 412/27
4,028,518 A * 6/1977 Boudouris ..... A61N 1/403 219/770
4,119,826 A * 10/1978 Chambley ..... H05B 6/48 219/778
4,197,851 A * 4/1980 Fellus ..... A61N 1/06 219/748
4,296,298 A * 10/1981 MacMaster ..... H05B 6/62 219/771
4,296,299 A * 10/1981 Stottmann ..... H05B 6/62 219/771
4,365,622 A * 12/1982 Harrison ..... H05B 6/54 219/770
4,409,541 A * 10/1983 Richards ..... G01R 31/54 324/505
4,471,537 A * 9/1984 Meda ..... D06F 58/206 34/77
4,499,818 A * 2/1985 Strong ..... A47J 37/1271 219/214
4,523,387 A * 6/1985 Mahan ..... D06F 58/02 219/741
4,529,855 A * 7/1985 Fleck ..... H05B 6/64 219/720
4,625,432 A * 12/1986 Baltes ..... A61L 2/06 34/196
4,638,571 A * 1/1987 Cook ..... F26B 13/104 219/770
4,692,581 A * 9/1987 Mizutani ..... H05B 6/60 219/780
4,845,329 A * 7/1989 Vaz ..... B60S 1/026 219/770
4,949,477 A * 8/1990 Geiger ..... D06F 58/30 34/604
5,064,979 A * 11/1991 Jaeger ..... F26B 3/343 219/681
5,152,075 A * 10/1992 Bonar ..... D06F 58/02 204/213
5,197,202 A * 3/1993 Jensen ..... F26B 13/001 34/231
5,282,321 A * 2/1994 Huttlin ..... B01J 2/16 34/585
5,303,484 A * 4/1994 Hagen ..... F26B 13/104 34/460
5,394,619 A * 3/1995 Kaplan ..... D06F 57/127 34/104
5,495,250 A * 2/1996 Ghaem ..... G06K 19/027 342/51
5,553,532 A * 9/1996 de la Luz-Martinez ..... A21D 8/06 219/388
5,659,972 A * 8/1997 Min ..... F26B 3/343 34/255
5,692,317 A * 12/1997 Manzolli ..... F26B 1/005 131/300
5,819,431 A * 10/1998 Lancer ..... A47K 10/48 34/90
5,838,111 A * 11/1998 Hayashi ..... H01J 37/32082 315/111.21
5,886,081 A * 3/1999 Sternowski ..... C08K 3/04 524/495
5,983,520 A * 11/1999 Kim ..... D06F 58/266 34/261
6,124,584 A * 9/2000 Blaker ..... F26B 3/347 219/770

(56) References Cited

U.S. PATENT DOCUMENTS 6,189,231 B1 * 2/2001 Lancer ..... A47K 10/48 34/90
6,303,166 B1 * 10/2001 Kolbe ..... A23B 4/01 219/771
6,367,165 B1 * 4/2002 Huttlin ..... B01J 2/16 34/168
6,421,931 B1 * 7/2002 Chapman ..... F26B 17/04 34/210
6,531,880 B1 * 3/2003 Schneider ..... G01R 31/58 324/539
6,546,109 B1 * 4/2003 Gnecco ..... H04R 25/652 174/353
6,649,879 B1 * 11/2003 Kohlstrung ..... A21B 1/26 126/21 A
6,812,445 B2 * 11/2004 Gorbold ..... H05B 6/54 219/764
7,526,879 B2 * 5/2009 Bae ..... D06F 58/206 34/239
7,619,403 B2 * 11/2009 Kashida ..... B03C 5/026 324/71.1
7,676,953 B2 * 3/2010 Magill ..... G01N 27/223 34/282
7,883,609 B2 * 2/2011 Petrenko ..... B60S 1/3805 204/242
RE43,519 E * 7/2012 Gnecco ..... H04R 25/60 381/322
8,499,472 B2 * 8/2013 Bari ..... D06F 58/16 34/528
8,789,599 B2 * 7/2014 Parsche ..... H01Q 9/24 166/302
8,826,561 B2 9/2014 Wisherd et al.
8,839,527 B2 * 9/2014 Ben-Shmuel ..... H05B 6/6458 34/260
8,943,705 B2 * 2/2015 Wisherd ..... F26B 3/343 34/255
9,127,400 B2 9/2015 Herman et al.
9,173,253 B2 10/2015 Wohl et al.
9,194,625 B2 11/2015 Herman et al.
9,200,402 B2 12/2015 Wisherd et al.
9,410,282 B2 * 8/2016 Herman ..... F26B 3/347
9,447,537 B2 * 9/2016 Wisherd ..... F26B 3/343
9,540,759 B2 * 1/2017 Herman ..... F26B 3/347
9,541,330 B2 1/2017 Herman et al.
9,546,817 B2 * 1/2017 Herman ..... D06F 58/266
9,605,899 B2 * 3/2017 Herman ..... D06F 58/266
9,645,182 B2 * 5/2017 Herman ..... G01R 29/0857
9,784,499 B2 * 10/2017 Herman ..... D06F 58/10
10,184,718 B2 1/2019 Herman et al.
10,323,881 B2 * 6/2019 Herman ..... D06F 60/00
10,533,798 B2 * 1/2020 Herman ..... F26B 3/343
2002/0047009 A1 * 4/2002 Flugstad ..... H05B 6/50 219/771
2003/0199251 A1 * 10/2003 Gorbold ..... H05B 6/54 455/66.1
2004/0149734 A1 * 8/2004 Petrenko ..... B60S 1/026 219/538
2005/0120715 A1 * 6/2005 Labrador ..... F02C 1/05 60/618
2005/0278972 A1 * 12/2005 Maruca ..... D06F 58/10 34/201
2005/0286914 A1 * 12/2005 Nagahama ..... G03G 21/1882 399/12
2006/0097726 A1 * 5/2006 Frederick ..... F21S 4/10 324/414
2006/0289526 A1 * 12/2006 Takizaki ..... H05B 6/708 219/746
2007/0045307 A1 * 3/2007 Tsui ..... F26B 3/347 219/775
2007/0113421 A1 * 5/2007 Uhara ..... D06F 25/00 34/275
2007/0193058 A1 * 8/2007 Zarembinski ..... D06F 58/10 34/202
2008/0134792 A1 * 6/2008 Lee ..... H01L 41/0825 73/645
2008/0256826 A1 * 10/2008 Zarembinski ..... F26B 25/06 34/562
2009/0151193 A1 * 6/2009 Moon ..... D06F 58/20 34/621
2009/0172965 A1 * 7/2009 Campagnolo ..... D06F 58/16 34/72
2009/0195255 A1 * 8/2009 Kalokitis ..... G01R 29/0878 324/522
2010/0043527 A1 * 2/2010 Marra ..... B03C 3/08 73/28.02
2010/0103095 A1 * 4/2010 Yamamoto ..... G06F 3/0346 345/156
2010/0115785 A1 * 5/2010 Ben-Shmuel ..... H05B 6/6458 34/260
2010/0146805 A1 * 6/2010 Kim ..... F26B 11/12 34/201
2011/0049133 A1 * 3/2011 Przybyla ..... H05B 6/60 219/647
2011/0245900 A1 * 10/2011 Turner ..... A61N 1/403 607/100
2011/0308101 A1 * 12/2011 Wisherd ..... D06F 58/30 34/255
2012/0000087 A1 * 1/2012 Da Riol ..... D06F 58/20 34/108
2012/0164022 A1 * 6/2012 Muginstein ..... A61L 2/12 422/22
2012/0247800 A1 * 10/2012 Shah ..... H05K 9/009 174/36
2012/0291304 A1 * 11/2012 Wisherd ..... F26B 11/0495 34/255
2013/0119055 A1 * 5/2013 Wohl ..... H05B 6/62 219/774
2013/0201068 A1 8/2013 Alexopoulos et al.
2013/0207674 A1 * 8/2013 Hahl ..... G01F 23/266 324/672
2013/0271811 A1 * 10/2013 Lam ..... G02F 1/163 359/266
2013/0316051 A1 * 11/2013 van der Voort ..... A23L 5/17 426/234
2014/0325865 A1 * 11/2014 Wisherd ..... F26B 11/0495 34/255
2015/0020403 A1 * 1/2015 Herman ..... F26B 3/34 34/255
2015/0047218 A1 * 2/2015 Herman ..... H05B 6/54 34/255
2015/0052775 A1 * 2/2015 Herman ..... F26B 3/34 34/255
2015/0089829 A1 * 4/2015 Herman ..... D06F 58/04 34/255
2015/0101207 A1 * 4/2015 Herman ..... D06F 58/266 34/255
2015/0102801 A1 * 4/2015 Herman ..... G08B 21/18 324/96
2015/0159949 A1 * 6/2015 Herman ..... F26B 3/34 34/255
2015/0187971 A1 * 7/2015 Sweeney ..... H01L 31/056 307/151
2016/0281290 A1 * 9/2016 Herman ..... D06F 60/00
2017/0089639 A1 * 3/2017 Herman ..... F26B 3/347
2017/0350651 A1 * 12/2017 Herman ..... F26B 3/34
2018/0031316 A1 * 2/2018 Herman ..... D06F 58/266
2018/0266041 A1 * 9/2018 Herman ..... F26B 3/347
2019/0128605 A1 * 5/2019 Herman ..... H05B 6/54
2019/0271504 A1 * 9/2019 Herman ..... F26B 3/347
2020/0149812 A1 * 5/2020 Herman ..... D06F 58/266

FOREIGN PATENT DOCUMENTS

EP 1753265 A1 2/2007
EP 2827087 A1 1/2015
EP 2840340 A2 2/2015
EP 3073008 A1 9/2016
GB 601855 A 5/1948
GB 1255292 A 12/1971

(56) References Cited

FOREIGN PATENT DOCUMENTS

| | | | |
|---|---|---|---|
| GB | 2019543 | A | 10/1979 |
| JP | 4307095 | A | 10/1992 |
| WO | 2009106906 | A1 | 9/2009 |
| WO | 2012001523 | A2 | 1/2012 |

OTHER PUBLICATIONS

European Search Report for Corresponding EP14175081.0, dated Dec. 4, 2014.
"British Help American Wounded: Rehabilitation and Treatment, UK, 1944", Ministry of Information Second World War Official.
European Search Report for Corresponding EP141790212, dated Feb. 3, 2015.
European Search Report for Counterpart EP161557822, dated Jul. 28, 2016.

* cited by examiner

APPLIANCE FOR DRYING ARTICLES

CROSS-REFERENCE TO RELATED APPLICATION(S)

This application claims priority to and is a continuation of U.S. patent application Ser. No. 15/782,426, filed Oct. 12, 2017, now U.S. Pat. No. 10,533,798, issued Dec. 26, 2019, which is a continuation of U.S. patent application Ser. No. 13/966,577, filed Aug. 14, 2013, both of which are incorporated herein by reference in its entirety.

BACKGROUND OF THE INVENTION

Dielectric heating is the process in which a high-frequency alternating electric field heats a dielectric material, such as water molecules. At higher frequencies, this heating is caused by molecular dipole rotation within the dielectric material, while at lower frequencies in conductive fluids, other mechanisms such as ion-drag are more important in generating thermal energy.

Microwave frequencies are typically applied for cooking food items and are considered undesirable for drying laundry articles because of the possible temporary runaway thermal effects random application of the waves in a traditional microwave. Radio frequencies and their corresponding controlled and contained e-field are typically used for drying of textiles.

When applying an RF electronic field (e-field) to a wet article, such as a clothing material, the e-field may cause the water molecules within the e-field to dielectrically heat, generating thermal energy that effects the rapid drying of the articles.

BRIEF DESCRIPTION OF THE INVENTION

One aspect of the invention is directed to a radio frequency (RF) laundry dryer including a non-rotatable, perforated planar drying surface for receiving and supporting wet textiles, an RF generator, an RF applicator located beneath the perforated planar drying surface and comprising an anode element and a cathode element operably coupled to the RF generator, wherein the arrangement is configured to generate an e-field between the anode element and the cathode element that extends above the perforated planar drying surface, at least one fan configured to flow air in a linear direction, a series of spaced baffles sequentially arranged along the linear direction of the air flow along the perforated planar drying surface and below the planar drying surface, and commonly oriented to redirect the air flow through the perforated planar drying surface, and an electromagnetic shield having a conductive layer and located between the fan and the cathode and anode elements to electromagnetically protect the at least one fan from the e-field.

Another aspect of the invention is directed to a method of drying laundry, including operating a fan to flow air beneath a perforated planar drying surface of a radio frequency (RF) applicator, redirecting the air flow, by way of a series of spaced baffles sequentially arranged in a linear direction of the air flow along the perforated planar drying surface and below the perforated planar drying surface and commonly oriented to redirect the air flow through the perforated planar drying surface while an e-field generated by a planar anode element and a planar cathode element extends above the perforated planar drying surface, and electromagnetically shielding the fan from the e-field. The planar anode element and the planar cathode element are coplanar.

DESCRIPTION OF EMBODIMENTS OF THE INVENTION

While this description may be primarily directed toward a laundry drying machine, the invention may be applicable in any environment using a radio frequency (RF) signal application to dehydrate any wet article.

Figure 1:
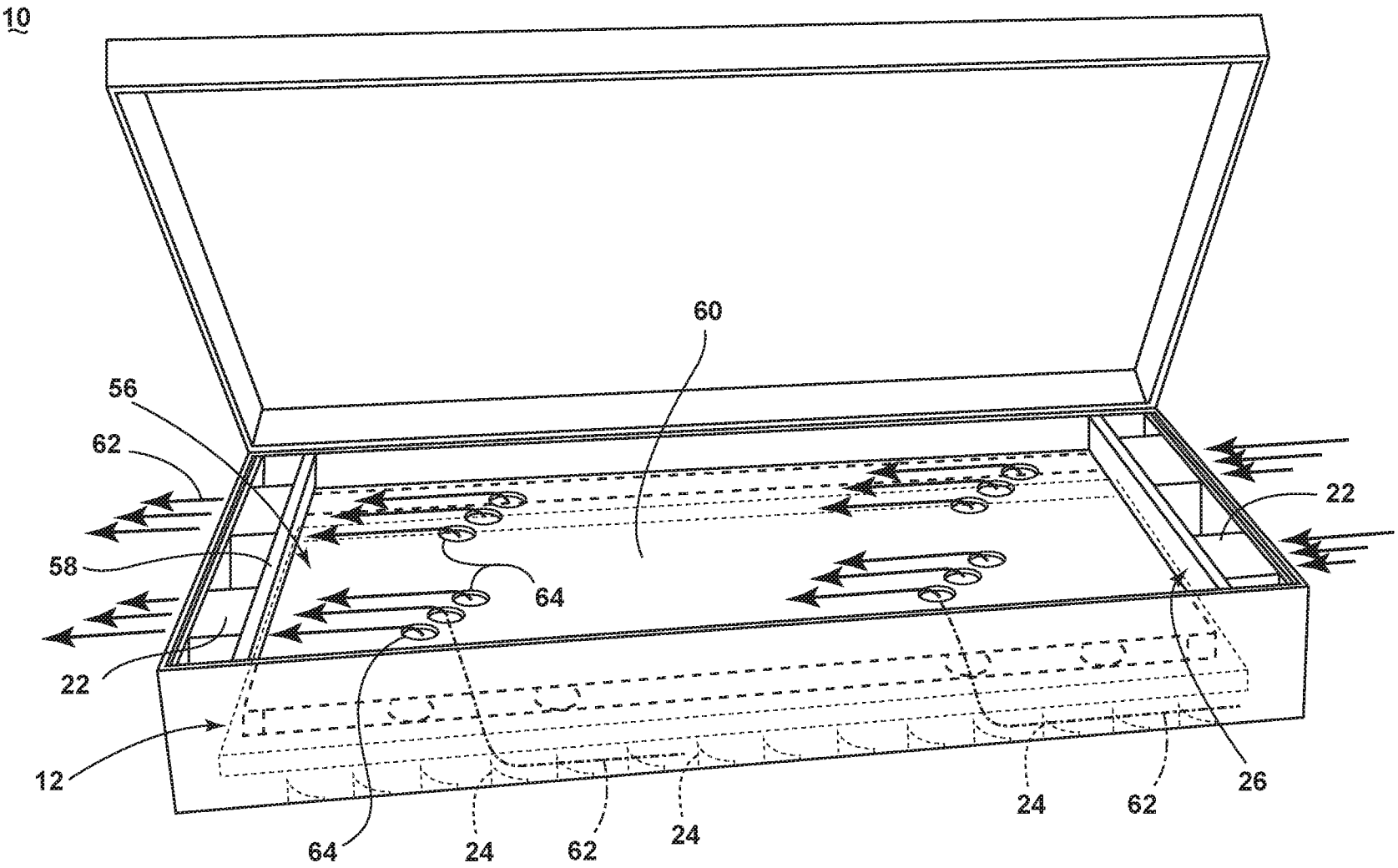
FIG. 1 is a schematic perspective view of the RF laundry dryer in accordance with an embodiment of the invention.
Figure 2:
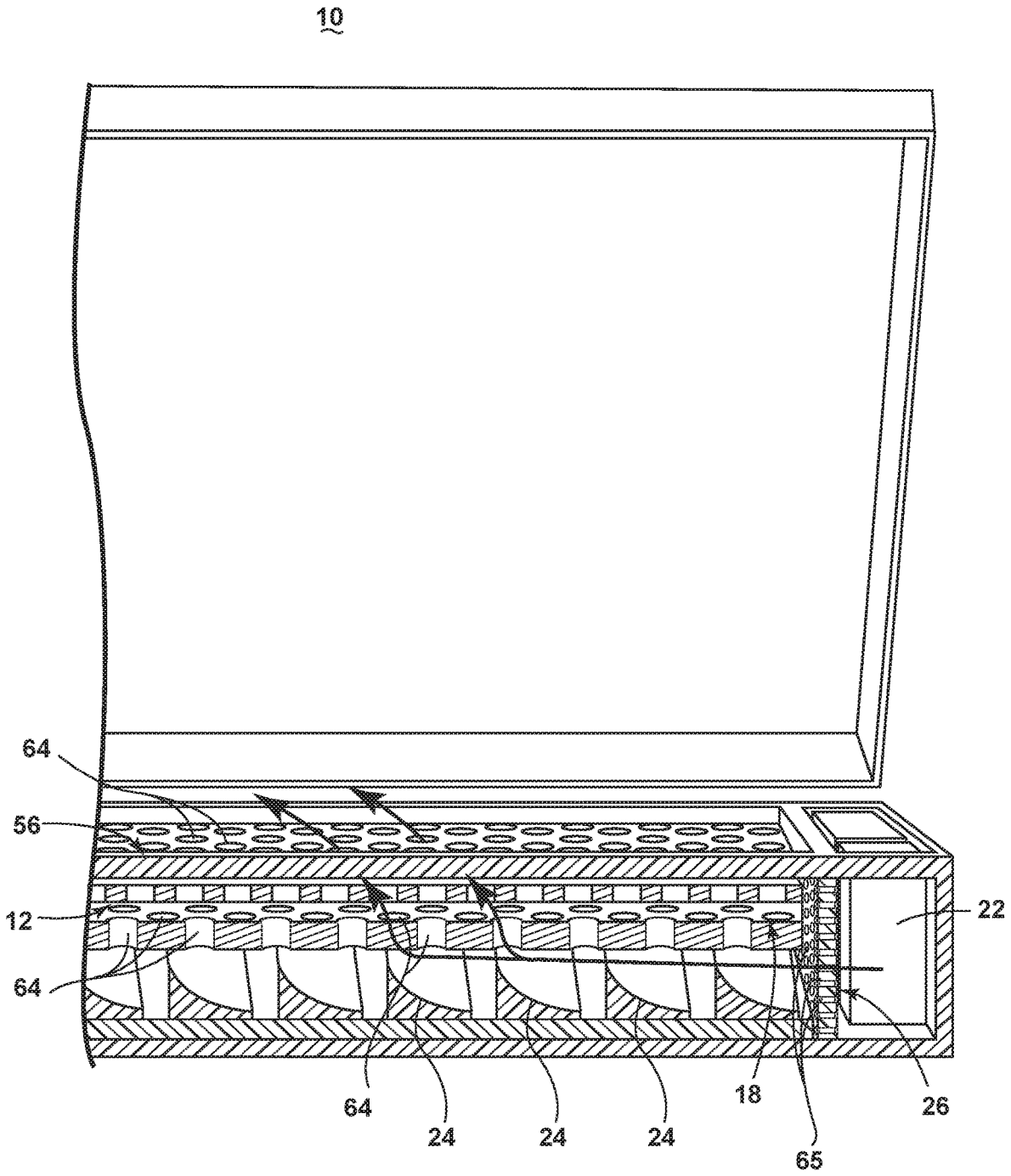
FIG. 2 is a partial sectional view of FIG. 1 showing air flow over the baffles of the RF laundry dryer in accordance with the embodiment of the invention shown in FIG. 1.
Figure 3:
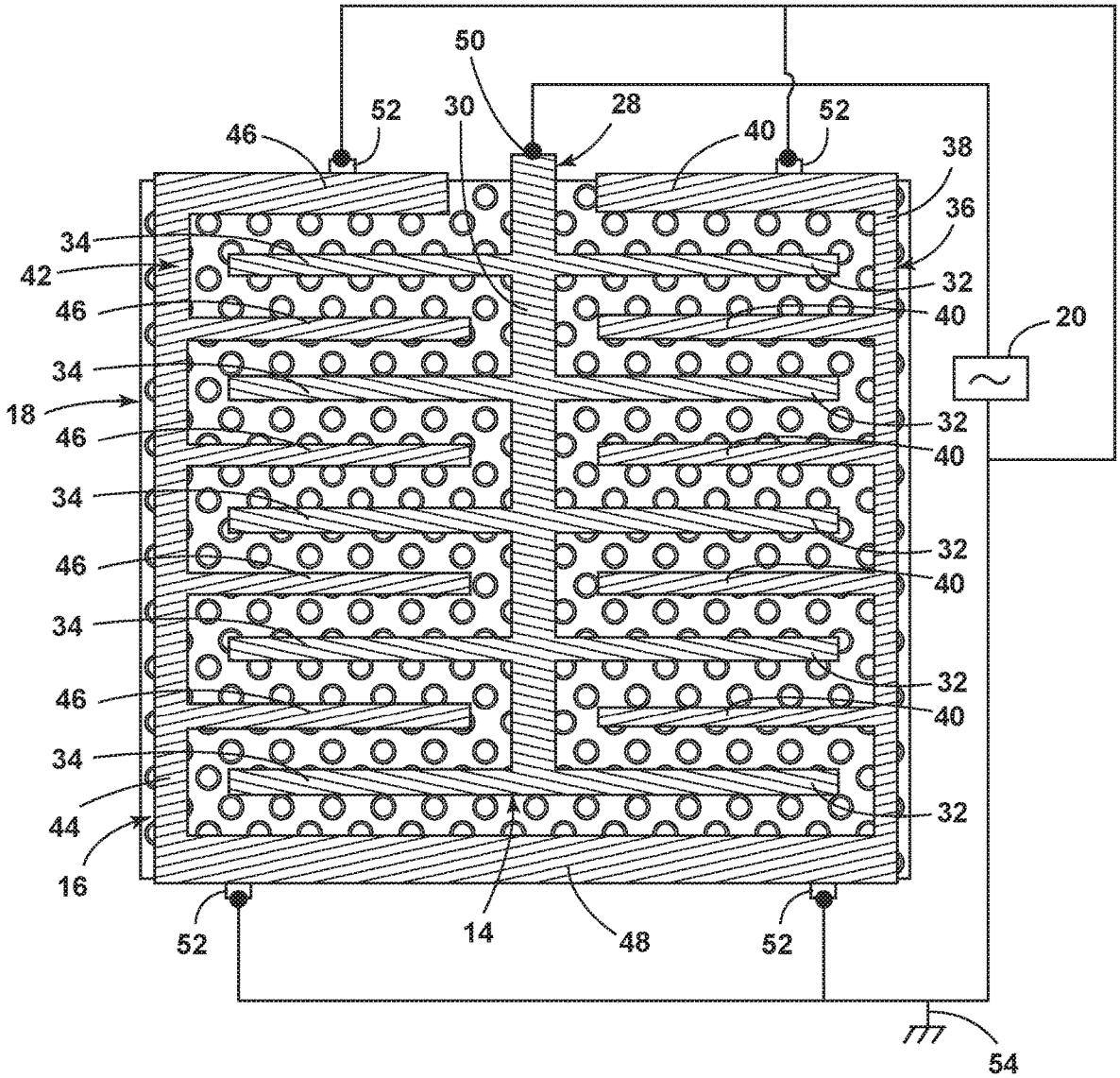
FIG. 3 is a schematic view of the anode and cathode elements of the RF applicator in accordance with the embodiment of the invention shown in FIG. 1.

FIG. 1 is a schematic illustration of an RF laundry drying appliance 10 according to an embodiment of the invention for dehydrating one or more articles of laundry. As illustrated in FIGS. 1-3, the RF laundry drying appliance 10 includes an RF applicator 12 that includes conductive elements, such as an anode element 14 and an opposing cathode element 16; each element supported by a perforated body 18. The laundry drying appliance 10 additionally includes an RF generator 20 and one or more fans 22 arranged relative to the perforated body 18 to flow air through the perforated body 18. A perforated electromagnetic shield 26 may be placed between the fans 22 and the RF applicator 12. One or more baffles 24 may be arranged between the one or more fans 22 and the perforated body 18 to direct air from the fans 22 through the perforated body 18.

As more clearly seen in FIG. 3, the anode element 14 may further include at least one anode contact point 50 and a tree element 28 having a base 30 from which extends a first plurality of digits 32 and a second plurality of digits 34. The first and second plurality of digits 32, 34 extend from opposite sides of the base 30 perpendicular to the length of the base 30. In a preferred embodiment of the anode element 14, each member of the first plurality of digits 32 has a one-to-one corresponding member of the second plurality of digits 34 that is coupled to the base 30 at the same location as the corresponding member of the second plurality of digits 34.

The cathode element 16 may further include at least one contact point 52, a first comb element 36 having a first base 38 from which extend a first plurality of digits 40 and a second comb element 42 having a second base 44 from which extend a second plurality of digits 46. The anode and cathode elements 14, 16 are fixedly mounted to the supporting perforated body 18 in such a way as to interdigitally arrange the first plurality of digits 32 of the tree element 28 of the anode 14 and the first plurality of digits 40 of the first comb element 36 of the cathode 16. Additionally, the anode and cathode elements 14, 16 are fixedly mounted to the supporting perforated body 18 in such a way as to interdigitally arrange the second plurality of digits 34 of the tree element 28 of the anode 14 and the second plurality of digits 46 of the second comb element 42 of the cathode 16.

All of the elements of the anode and cathode elements 14, 16 are preferably arranged in a coplanar configuration. The first base element 38 of the cathode element 16 and the second base element 44 of the cathode element 16 will be in physical connection by way of a third interconnecting base element 48 that effectively wraps the first and second comb elements 36, 42 of the cathode element 16 around the anode element 14 in a given plane to form a single point of access for external connection of the anode's base element 30 to a contact point 50. Other arrangements of the digits, base elements and contact points of the anode may be implemented. For example, the digits of either the first plurality or second plurality of digits 32, 34 may not be perpendicular to the base element 30. The digits of either the first plurality and the second plurality of digits 32, 34 may not intersect the base element 30 at the same angle or location. The digits may further include geometries more complicated than the simple linear structures shown in FIG. 3. Many alternative configurations may be implemented to form the plurality of digits, the base elements and the interconnections between the base elements and the digits of the anode and cathode elements.

The anode and cathode elements 14, 16 may be fixedly mounted to the supporting perforated body 18 by, for example, adhesion, fastener connections, or laminated layers. Alternative mounting techniques may be employed.

The RF applicator 12 may be configured to generate a field of electromagnetic radiation (e-field) within the radio frequency spectrum between the anode 14 and cathode 16 elements. The anode element 14 of the RF applicator 12 may be electrically coupled to an RF generator 20 by a contact point 50 on the anode element 14. The cathode element 16 of the RF applicator may be electrically coupled to the RF generator 20 by one or more additional contact points 52 of the cathode element 16. The cathode contact points 52 and their connection to the RF generator 20 are additionally connected to an electrical ground 54. In this way, the RF generator 20 may apply an RF signal of a desired power level and frequency to energize the RF applicator 12. One such example of an RF signal generated by the RF applicator 12 may be 13.56 MHz. The radio frequency 13.56 MHz is one frequency in the band of frequencies between 13.553 MHz and 13.567 MHz. The band of frequencies between 13.553 MHz and 13.567 MHz is known as the 13.56 MHz band and is one of several bands that make up the industrial, scientific and medical (ISM) radio bands. The generation of another RF signal, or varying RF signals, particularly in the ISM radio bands, is envisioned.

Microwave frequencies are typically applied for cooking food items. However, their high frequency and resulting greater dielectric heating effect make microwave frequencies undesirable for drying laundry articles. Radio frequencies and their corresponding lower dielectric heating effect are typically used for drying of laundry. In contrast with a conventional microwave heating appliance, where microwaves generated by a magnetron are directed into a resonant cavity by a waveguide, the RF applicator 12 induces a controlled electromagnetic field between the anode and cathode elements 14, 16. Stray-field or through-field electromagnetic heating; that is, dielectric heating by placing wet articles near or between energized applicator elements, provides a relatively deterministic application of power as opposed to conventional microwave heating technologies where the microwave energy is randomly distributed (by way of a stirrer and/or rotation of the load). Consequently, conventional microwave technologies may result in thermal runaway effects that are not easily mitigated when applied to certain loads (such as metal zippers etc.). It is understood that the differences between microwave ovens and RF dryers arise from the differences between the implementation structures of applicator vs. magnetron/waveguide, which renders much of the microwave solutions inapplicable for RF dryers. It may be instructive to consider how the application of electromagnetic energy in RF dryers differs than the application of electromagnetic energy in conventional microwave technology with an analogy. For example, if electromagnetic energy is analogous to water, then a conventional microwave acts as a sprinkler randomly radiating in an omni-directional fashion whereas the RF dryer is akin to a wave pool.

Figure 4:
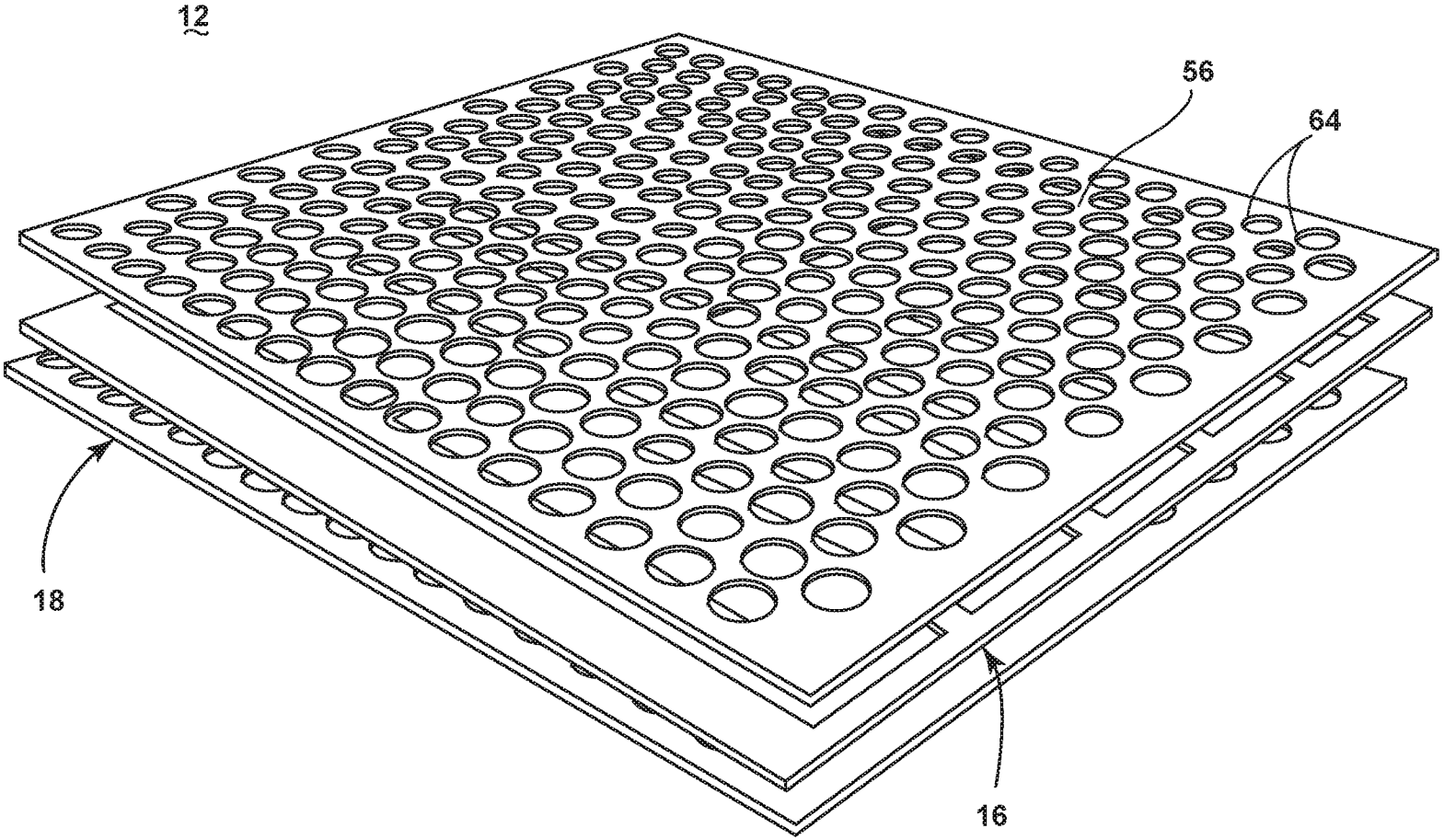
FIG. 4 is a schematic perspective view of the perforated body supporting the anode and cathode elements of the RF applicator in accordance with the embodiment of the invention shown in FIG. 1.

Each of the conductive anode and cathode elements 14, 16 remain at least partially spaced from each other by a separating gap, or by non-conductive segments. By fixedly mounting the anode and cathode elements 14, 16 to the supporting perforated body 18 as described above, the anode and cathode elements 14, 16 may remain appropriately spaced. Referring now to FIG. 4, another perforated body 56 may be placed above the anode and cathode elements 14, 16. In this configuration, the anode and cathode elements 14, 16 may be sandwiched between the perforated bodies 18, 56. The supporting perforated body 18, 56 may be made of any suitable low loss, fire retardant materials, or at least one layer of insulating materials that isolates the conductive anode and cathode elements 14, 16.

The supporting perforated bodies 18, 56 may also provide a rigid structure for the RF laundry drying appliance 10 shown in FIG. 1, or may be further supported by secondary structural elements, such as a frame or truss system. Alternative support structures other than perforated bodies 18, 56 may be implemented to support the anode and cathode elements. The presence or geometrical shape and configuration of foramina in the supporting structure may be instantiated in many ways depending upon the implementation.

Returning to FIG. 1 in accordance with an embodiment of the invention, the perforated body 56 including the arrangement of perforations 64 as best seen in FIG. 4 may further include non-conductive walls 58 wherein the walls 58 may be positioned above or below the interdigitally arranged pluralities of digits 32, 34, 40, 46 and extending above and/or below the perforated body 56. The bed further includes a flat upper surface 60 for receiving wet textiles and forms a drying surface located on which textiles may be supported.

The aforementioned structure of the RF laundry drying appliance 10 operates by creating a capacitive coupling between the pluralities of digits 32, 40 and 34, 46 of the anode element 14 and the cathode element 16, at least partially spaced from each other. During drying operations, wet textiles to be dried may be placed on the upper surface 60 of the bed. During, for instance, a predetermined cycle of operation, the RF applicator 12 may be continuously or intermittently energized to generate an e-field between the capacitive coupling which interacts with liquid in the textile. The liquid residing within the e-field will be dielectrically heated to effect a drying of the textile.

Figure 5:
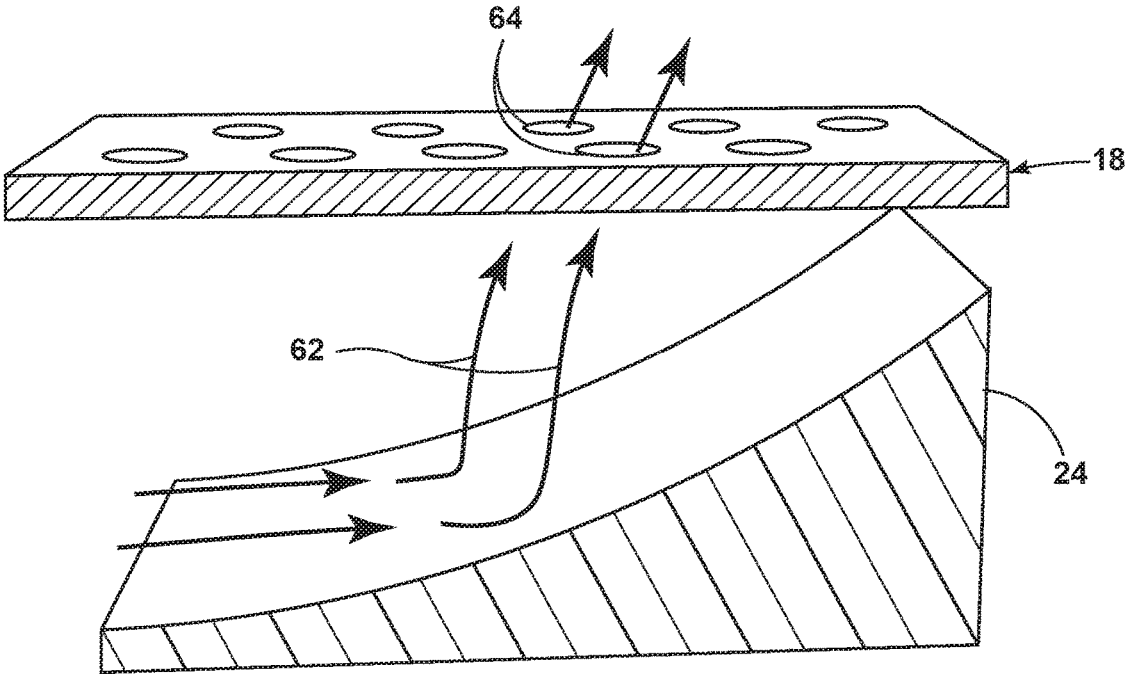
FIG. 5 is a schematic perspective view of a baffle of the RF laundry dryer in FIG. 1 directing air from a fan through the perforated body of the RF applicator according to the embodiment of the invention shown in FIG. 1.

During the drying process, water in the wet clothing may become heated to the point of evaporation. As seen in FIGS. 1 and 5, to aid in the drying process, air flow 62 from one or more fans 22 may be directed through the perforated bodies 18, 56 and through the drying textiles placed on the upper surface 60 of the bed. The perforations 64 in the perforated bodies 18, 56 direct the air flow 62 through the entire surface of the textile and more uniformly dry the textile. The perforations 64 in the perforated bodies 18, 56 may be aligned vertically to maximize the airflow. Additionally, as best seen in FIG. 2 and FIG. 5, to uniformly direct the air flow 62 through the entire surface of the perforated bodies 18, one or more baffles 24 are located between the one or more fans 22 to direct the air from the fans 22 from a substantially horizontal to a substantially vertical flow through the perforations of the perforated body 18. Fans 22 may be placed on either side of the bed so that air may be pushed and/or pulled through the applicator.

Alternatively, the RF dryer may be configured in a substantially vertical orientation. The relative configuration of the fans, the baffles and the perforated body may enable air flow to be directed along a vector substantially orthogonal to the drying surface and through the perforations of the perforated body 18. In this way, it is understood that the air flow can be directed in any particular direction be it up or down or left or right without loss of effectiveness as long as the air flow is uniformly directed through the perforated body.

The perforated body 18 and the anode, cathode and drying surface of the RF laundry drying appliance 10 may be placed between the one or more fans 22. To act as an electromagnetic shield 26, a perforated body may contain at least one layer of a conductive material to protect the one or more fans 22 from the e-field generated by the RF applicator 12. The dimensions of the perforations 64 provided in the perforated body 18 are selected to be of a size to maximize air flow and prevent textile material from drooping into the perforations.

The e-field across the anode and cathode elements 14, 16 may not pass through the perforated body of the electromagnetic shield 26 and electrically interfere with the operation of the fans 22. The dimensions of the perforations 65 may be selected according to one of many functions related to wavelength. For example, selecting the dimension of the perforations 65 to be approximately $1/20^{th}$ or smaller of the wavelength of the e-field results in perforations smaller than 1.1 meters for an RF applicator operating at 13.6 MHz to provide an effective electromagnetic shield for the one or more fans 22. A second example arises when considering an RF applicator operating at a frequency in the 2.4 GHz ISM band. In this example, the largest dimension of the perforations may not exceed 0.63 cm to be approximately $1/20^{th}$ the wavelength of the RF applicator. However, due to magnetics, near-field effects and harmonics, the dimensions of the perforations are much smaller and are generally selected to be as small as possible without limiting air flow. Other methods may be used and may primarily be driven by the standards required relating to the mitigation or prevention of electromagnetic leakage.

In this way, textiles may be dried in the RF laundry dryer by flowing air from at least one fan 22 through the perforations in the perforated body 18 onto textiles supported by the RF applicator 12 and electromagnetically shielding the at least one fan 22 during the flowing of the air from the bottom to the top or the top to the bottom of the RF applicator 12. The vertical flowing of the air through the RF applicator 12 via the perforations of the perforated body 18 is directed, in part, by the baffles 24 placed on top or underneath the RF applicator 12. By forming a composite of the perforated bodies 18, 56 and the anode and cathode elements 14, 16 in the RF applicator 12, the structure effectively increases drying efficiency by directing air flow 62 through the RF applicator 12 and provides electromagnetic shielding of electronic components such as fans 22.

Many other possible configurations in addition to that shown in the above figures are contemplated by the present embodiment. For example, one embodiment of the invention contemplates different geometric shapes for the laundry drying appliance 10, such as a substantially longer, rectangular appliance 10 where the anode and cathode elements 14, 16 are elongated along the length of the appliance 10, or the longer appliance 10 includes a plurality of anode and cathode element 14, 16 sets.

In such a configuration, the upper surface 60 of the bed may be smooth and slightly sloped to allow for the movement of wet laundry across the laundry drying appliance 10, wherein the one or more anode and cathode element 14, 16 sets may be energized individually or in combination by one or more RF applicators 12 to dry the laundry as it traverses the appliance 10.

The aspects disclosed herein provide a laundry treating appliance using RF applicator to dielectrically heat liquid in wet articles to effect a drying of the articles. One advantage that may be realized in the above aspects may be that the above described aspects are able to dry articles of clothing during rotational or stationary activity, allowing the most efficient e-field to be applied to the clothing for particular cycles or clothing characteristics. A further advantage of the above aspects may be that the above aspects allow for selective energizing of the RF applicator according to such additional design considerations as efficiency or power consumption during operation.

Additionally, the design of the anode and cathode may be controlled to allow for individual energizing of particular RF applicators in a single or multi-applicator embodiment. The effect of individual energization of particular RF applicators results in avoiding anode/cathode pairs that would result in no additional material drying (if energized), reducing the unwanted impedance of additional anode/cathode pairs and electromagnetic fields, and an overall reduction to energy costs of a drying cycle of operation due to increased efficiencies.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A radio frequency (RF) laundry dryer comprising:

a non-rotatable, perforated planar drying surface for receiving and supporting wet textiles;

an RF generator;

an RF applicator located beneath the non-rotatable, perforated planar drying surface and comprising an anode element and a cathode element operably coupled to the RF generator, wherein the arrangement of the RF applicator is configured to generate an e-field between the anode element and the cathode element that extends above the non-rotatable, perforated planar drying surface;

at least one fan configured to flow air in a linear direction;

a series of spaced baffles sequentially arranged along the linear direction of the air flow along the non-rotatable, perforated planar drying surface and below the planar drying surface, and commonly oriented to redirect the air flow through the non-rotatable, perforated planar drying surface; and an electromagnetic shield having a conductive layer and located between the fan and the cathode and anode elements to electromagnetically protect the at least one fan from the e-field.

2. The RF laundry dryer of claim 1 wherein the cathode element is a planar cathode element.

3. The RF laundry dryer of claim 2 wherein the anode element is a planar anode element.

4. The RF laundry dryer of claim 3 wherein the anode element and the cathode element are coplanar.

5. The RF laundry dryer of claim 1 wherein the electromagnetic shield comprises a second perforated body supporting the anode element and the cathode element, and wherein a dimension of perforations of the second perforated body is selected to at least one of mitigate or prevent e-field leakage toward the fan.

6. The RF laundry dryer of claim 1 wherein at least one of the series of spaced baffles is fluidly located between the at least one fan and the non-rotatable, perforated planar drying surface.

7. The RF laundry dryer of claim 1 wherein the RF generator is configured to generate an e-field at a frequency between 13.553 MHz and 13.567 MHz.

8. The RF laundry dryer of claim 1 wherein the anode element and the cathode element are sandwiched between the non-rotatable, perforated planar drying surface and a second perforated planar body.

9. The RF laundry dryer of claim 8 wherein the non-rotatable, perforated planar drying surface and the second perforated planar body comprise perforations of a size to maximize air flow through the non-rotatable, perforated planar drying surface and the second perforated planar body.

10. The RF laundry dryer of claim 8 wherein the perforations of the non-rotatable, perforated planar drying surface and the second perforated planar body are aligned.

11. The RF laundry dryer of claim 10 wherein the series of spaced baffles are further oriented to redirect the air flow through the aligned perforations of the non-rotatable, perforated planar drying surface and the second perforated planar body.

12. The RF laundry dryer of claim 1 wherein the non-rotatable, perforated planar drying surface includes perforations of a size to prevent textile material placed on the non-rotatable, perforated planar drying surface from drooping into the RF applicator.

13. The RF laundry dryer of claim 1 wherein the anode element includes a tree element having a tree base from which extend a first plurality of digits and wherein the cathode element includes a comb element having a comb base from which extend a second plurality of digits, and wherein the first plurality of digits and the second plurality of digits are interdigitally arranged.

14. The RF laundry dryer of claim 13 wherein the anode element includes a third plurality of digits extending from a side of the tree base opposite to the first plurality of digits.

15. The RF laundry dryer of claim 14 wherein the cathode element includes a fourth plurality of digits, and wherein the third plurality of digits and the fourth plurality of digits are interdigitally arranged.

16. A method of drying laundry, comprising:

operating a fan to flow air beneath a perforated planar drying surface of a radio frequency (RF) applicator;

redirecting the air flow, by way of a series of spaced baffles sequentially arranged in a linear direction of the air flow along the perforated planar drying surface and below the perforated planar drying surface and commonly oriented to redirect the air flow through the perforated planar drying surface while an e-field generated by a planar anode element and a planar cathode element extends above the perforated planar drying surface; and electromagnetically shielding the fan from the e-field;

wherein the planar anode element and the planar cathode element are coplanar.

17. The method of claim 16 further including disposing at least one perforation of the perforated planar drying surface and at least one of the series of spaced baffles relative to each other such that the redirecting the air is maximized.

18. The method of claim 16 wherein the redirecting the air includes redirecting the air through a wet textile.

19. The method of claim 16 wherein shielding the fan from the e-field includes shielding by way of an electromagnetic shield disposed between the fan and the RF applicator.

20. The method of claim 16 wherein the redirecting the air includes redirecting the air from a vector parallel to the perforated planar drying surface to a vector orthogonal to the perforated planar drying surface.

* * * * *